US005848493A

United States Patent [19]

Gasper

[11] Patent Number: 5,848,493

[45] Date of Patent: Dec. 15, 1998

[54] APPARATUS FOR ATTACHING A FLOWER TO CHRISTMAS TREE

[76] Inventor: Ekkehart Gasper, 10803 Colton St., Fairfax, Va. 22032

[21] Appl. No.: 679,819

[22] Filed: Jul. 15, 1996

[51] Int. Cl.[6] ..... A01G 5/00; A47G 7/00

[52] U.S. Cl. ..... 47/41.15; 47/41.01; 47/41.11; 428/23

[58] Field of Search ..... 428/23; 47/41.15, 47/41.01, 41.11, 41.14, 41.13

[56] References Cited

U.S. PATENT DOCUMENTS

| | | | |
|---|---|---|---|
| 1,379,340 | 5/1921 | Hegamin . | |
| 1,613,386 | 1/1927 | Ekdahl | 428/23 |
| 2,492,039 | 12/1949 | Gilowitz . | |
| 2,782,296 | 2/1957 | Walter . | |
| 3,050,619 | 8/1962 | Abramson . | |
| 3,768,685 | 10/1973 | Eckman | 47/41.15 |
| 3,949,568 | 4/1976 | Gallagher | 47/41.15 |
| 4,418,496 | 12/1983 | Koistinen . | |
| 4,418,497 | 12/1983 | Mastriano . | |
| 5,195,270 | 3/1993 | Domurat . | |

FOREIGN PATENT DOCUMENTS

| | | | |
|---|---|---|---|
| 2670077 | 12/1990 | France . | |
| 4102410 | 4/1992 | Japan | 47/67 |
| 8-140805 A | 6/1996 | Japan . | |
| WO 96/03028 | 2/1996 | WIPO . | |

*Primary Examiner*—Michael J. Carone
*Assistant Examiner*—Joanne C. Downs
*Attorney, Agent, or Firm*—Oliff & Berridge, PLC

[57] ABSTRACT

An apparatus for attaching a flower to a Christmas tree includes a container that defines an aperture at an upper end. An attaching mechanism projects from the container and attaches the container to the Christmas tree. The apparatus keeps the flower fresh while attached to the Christmas tree by maintaining a stem of the flower immersed in water that is held in the container.

17 Claims, 13 Drawing Sheets

APPARATUS FOR ATTACHING A FLOWER TO CHRISTMAS TREE

BACKGROUND OF THE INVENTION

1. Field of the Invention

This invention relates to Christmas tree decorations, and in particular to an apparatus for attaching a flower to a Christmas tree.

2. Description of Related Art

The Christian holiday of Christmas has been celebrated for at least a millennium. Over the centuries, different cultures have celebrated Christmas in various ways. For hundreds of years Europeans have decorated trees, and in particular conifers. The tradition of decorating conifers has become popular in America and other areas of the globe.

In many cultures, it is popular to decorate conifers with electric lights and glass ornaments. In some countries, especially in Germany, Christmas trees are often decorated with flowers. The popularity of decorating Christmas trees with flowers is due to the fact that flowers are aesthetically pleasing, can be provided in a wide variety of shapes and colors, and are fragrant, non-toxic and lightweight. Although Christmas is celebrated during the winter in America and Europe, advances in transportation and indoor agricultural techniques have made it feasible to provide large quantities of flowers at Christmas time.

However, the problem arises that flowers placed along the branches of Christmas trees do not stay fresh very long. The flowers die and must be replaced frequently. This, replacement is tedious, time consuming and expensive.

The industry lacks a device that attaches a flower to a Christmas tree which also keeps the flower fresh over extended periods of time.

SUMMARY OF THE INVENTION

It is, therefore, an object of the invention to provide an apparatus and method for increasing the longevity of flowers attached to a Christmas tree.

It is also an object of the present invention to attach flowers to a Christmas tree with an apparatus that is aesthetically pleasing.

The apparatus for attaching a flower to a Christmas tree in accordance with the invention includes a container that defines an aperture at an upper end. A mechanism for attaching the container to the Christmas tree projects from the container.

Further objects, details and advantages of the invention will be apparent from the following detailed description, when read in conjunction with the drawings.

DETAILED DESCRIPTION OF PREFERRED EMBODIMENTS

Figure 1:
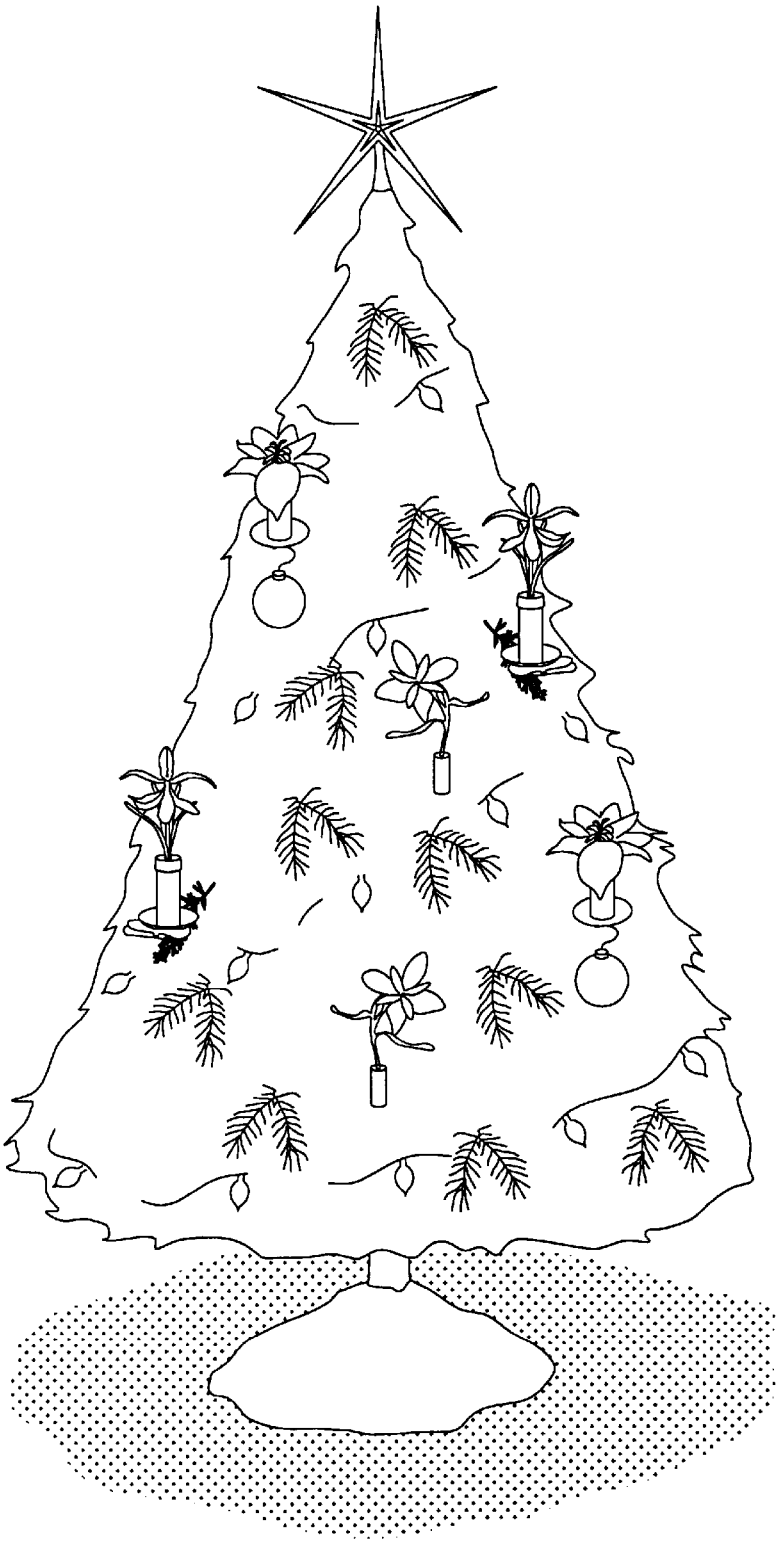
FIG. 1 is a perspective view of a Christmas tree decorated with multiple embodiments of an apparatus for attaching a flower to a Christmas tree in accordance with the invention.

FIG. 1 is a perspective view of a Christmas tree decorated with multiple embodiments of an apparatus for attaching a flower to a Christmas tree in accordance with the invention. The Christmas tree 2 is elongated. A base of the Christmas tree is disposed in a stand 4 which maintains the Christmas tree in an upright orientation.

Figure 2:
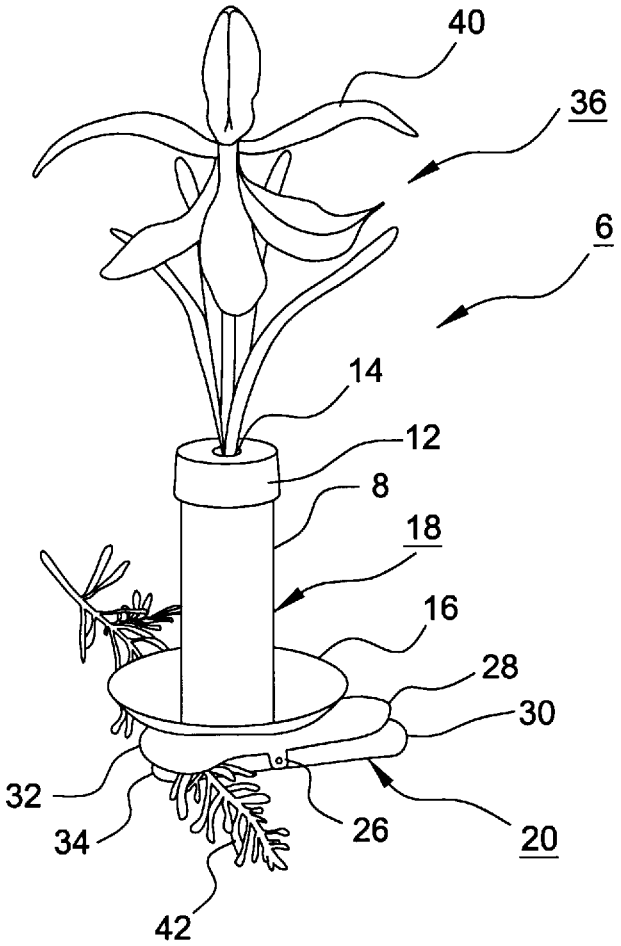
FIG. 2 is a perspective view of an apparatus for attaching a flower to a Christmas tree in accordance with a preferred embodiment of the invention.
Figure 3:
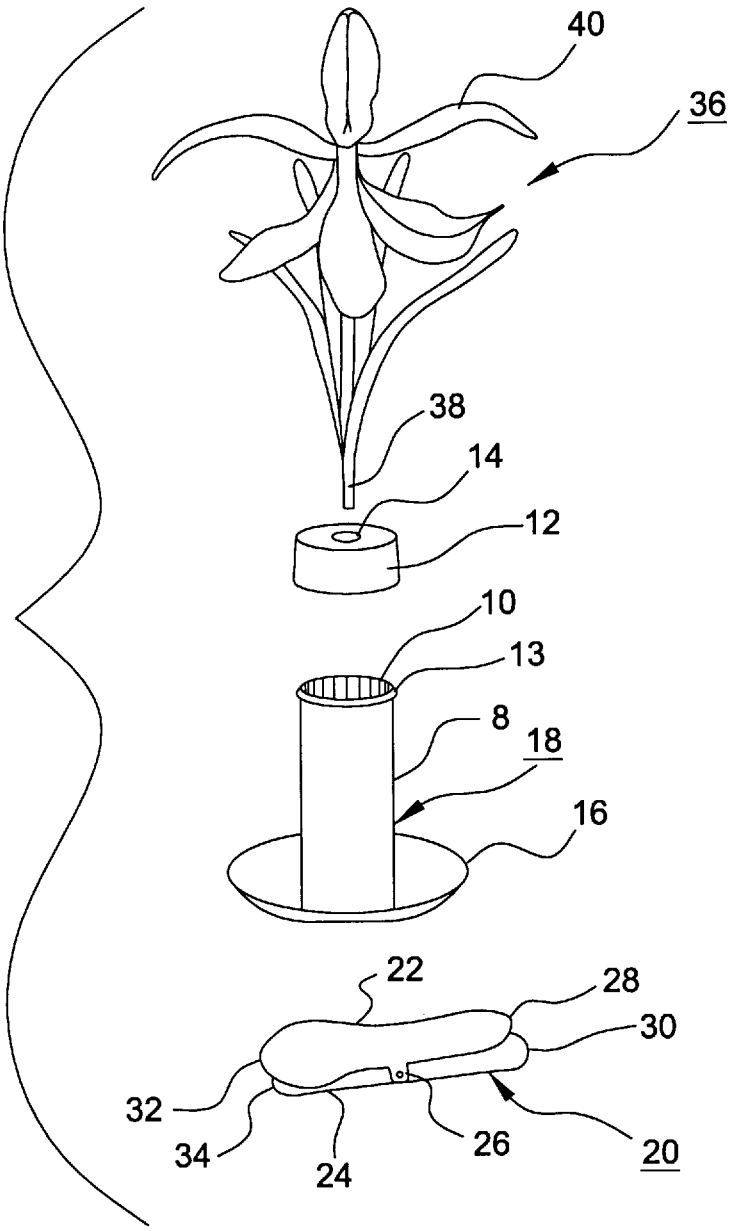
FIG. 3 is an exploded perspective view of the apparatus of FIG. 2.
Figure 4:
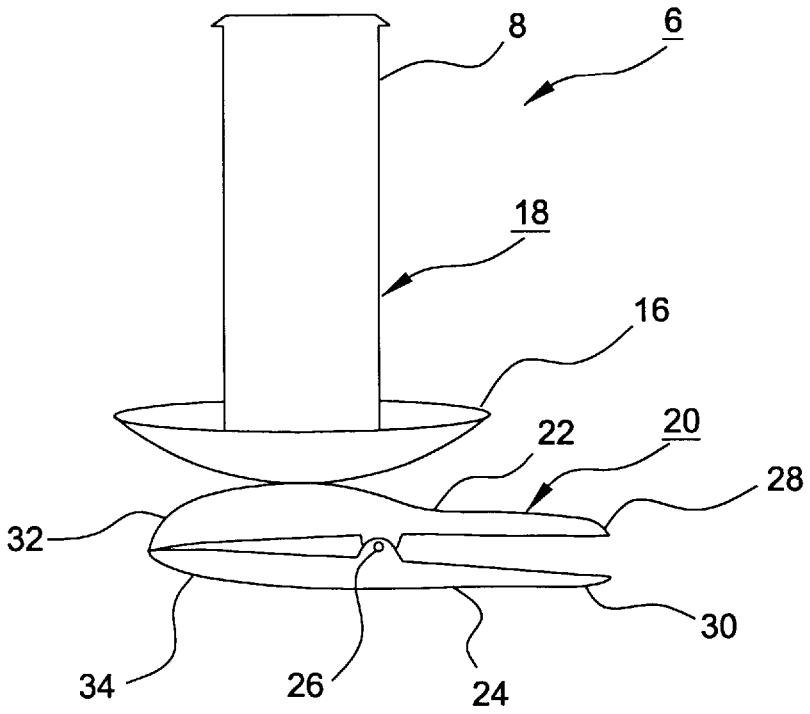
FIG. 4 is a partial perspective view of the apparatus of FIG. 2.

FIG. 2 is a perspective view of an apparatus for attaching a flower to a Christmas tree in accordance with a preferred embodiment of the invention. FIG. 3 is an exploded perspective view of the apparatus of FIG. 2. FIG. 4 is a partial perspective view of the apparatus of FIG. 2.

The apparatus for attaching a flower to a Christmas tree 6 includes a container 8. The container 8 is hollow, elongated and defines an aperture 10 at an upper end, as shown in FIG. 3. The container 8 is a circular cylinder.

A top 12 is disposed at the upper end of the container 8 to cover the aperture 10. The top 12 is maintained in place on the container 8 by virtue of an annular tab 13 at the upper end of the container 8. The top 12 defines a hole 14 that is smaller than the aperture 10 of the container 8.

A saucer 16 is disposed at a bottom end of the container 8. The saucer 16 is substantially circular with upwardly extending ends. The bottom end of the container 8 is disposed in the center of the saucer 16. The container 8 and the saucer 16 form a container assembly 18. In the preferred embodiment, the container assembly 18 is formed from a single piece of synthetic resin.

An attaching mechanism 20 is disposed at a base of the container assembly 18. The attaching mechanism 20 includes a pair of opposing members 22 and 24 that form a jaw. A top portion of opposing member 28 is attached to the base of the container assembly 18 by glue or epoxy. The opposing members 22 and 24 are connected to each other by a pin 26.

Each of the opposing members 22 and 24 has a proximal end 28 and 30 and a distal end 32 and 34. The opposing members 22 and 24 are manually operable such that moving the proximal ends 28 and 30 together moves the distal ends 32 and 34 apart.

In the operation of the apparatus for attaching a flower to a Christmas tree 6, water is poured into the container 8 via the aperture 10. Water that is spilled while filling up the container 8 is caught in the saucer 16 by virtue of its upwardly extending ends. After a sufficient amount of water is poured into the container 8, the top 12 is placed on the container 8 to cover the aperture 10. A stem 38 of a flower 36 is inserted through the hole 14 of the top 12 and into the container 8. The flower 36 is disposed in the container 8 such that at least a portion of the stem 38 is immersed in the water and the pedals 40 or flowering portion project from the top 12.

The apparatus 6 is attached to the Christmas tree 2 by manually pressing the proximal ends 28 and 30 of the opposing members 22 and 24 together. The apparatus 6 is positioned such that a branch 42 of the Christmas tree 2 is disposed in a gap separating the distal ends 32 and 34 of the opposing members 22 and 24. The proximal ends 28 and 30 are released and the distal ends 32 and 34 of the opposing members 22 and 24 clamp the branch 42. The apparatus 6 is held in place on the Christmas tree 2 by virtue of the clamping operation of the opposing members 22 and 24. The apparatus 6 is positioned on the Christmas tree 2 such that the direction of elongation of the container 8 is substantially parallel to the direction of elongation of the Christmas tree 2 so that the water does not spill out of the top 12. The flower 36 is kept fresh while attached to the Christmas tree 2 by virtue of its stem 38 being immersed in the water held by the container 8.

Figure 5:
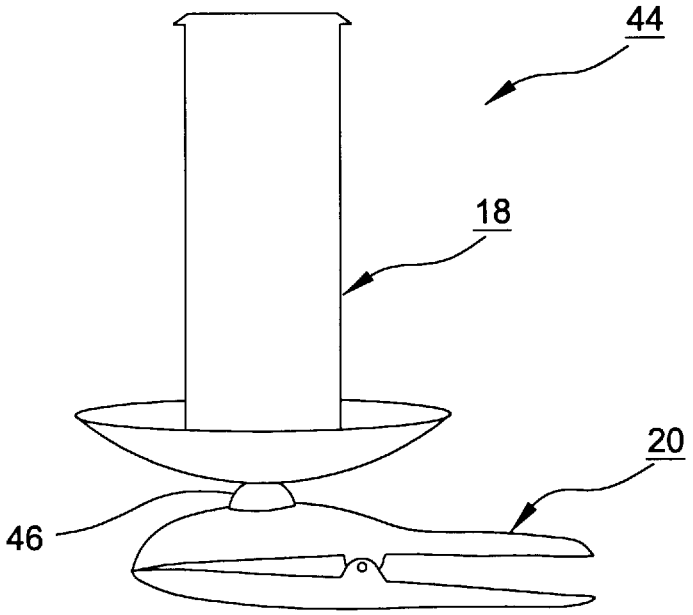
FIG. 5 is a partial perspective view of another embodiment of an apparatus for attaching a flower to a Christmas tree.

FIG. 5 a partial perspective view of another embodiment of an apparatus for attaching a flower to a Christmas tree. The apparatus 44 is identical to the apparatus 6 of the preferred embodiment except that the attaching mechanism 20 is not attached to the container assembly 18 by glue or epoxy. Instead, the attaching mechanism 20 is attached to the container assembly 18 by a ball joint 46. The ball joint 46 enables the container assembly 18 to be oriented at a variety of angles relative to the attaching mechanism 20 and the Christmas tree 2. The ball joint 46 allows the apparatus 6 to be positioned such that the direction of elongation of the container 8 is substantially parallel to the direction of elongation of the Christmas tree 2 even when the apparatus 6 is attached to a branch that does not extend perpendicular to the direction of elongation of the Christmas tree 2.

Figure 6:
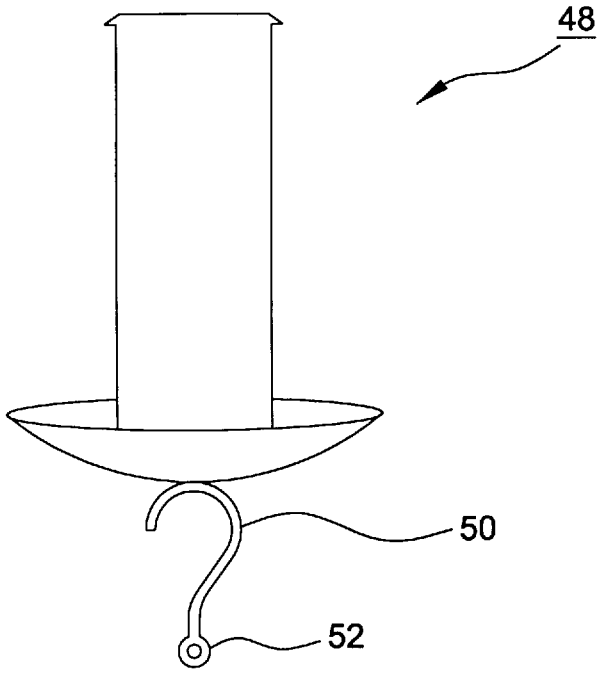
FIG. 6 is a partial perspective view of another embodiment of an apparatus for attaching a flower to a Christmas tree.

FIG. 6 is a partial perspective view of another embodiment of an apparatus for attaching a flower to a Christmas tree. The apparatus 48 is identical to the apparatus 6 of the preferred embodiment except for the attaching mechanism. A top portion of a hook 50 is attached to the base of the container assembly 18 by glue or epoxy. A bottom portion of the hook 50 defines an opening 52. A conventional Christmas tree ornament may be hung from the apparatus 48 by inserting conventional attachment hooks through the opening 52. The apparatus 48 is attached to the Christmas tree 2 by positioning the hook 50 circumferentially around a branch.

Figure 7:
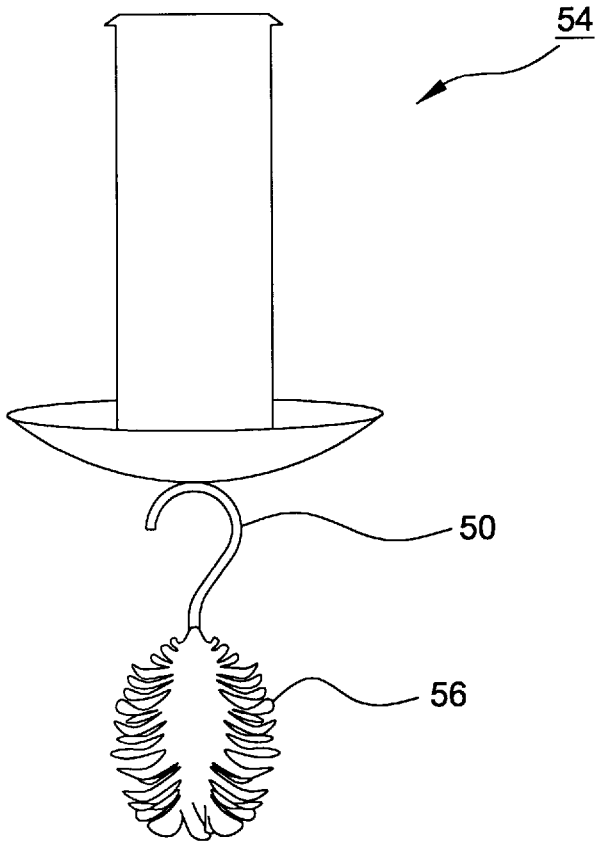
FIG. 7 is a partial perspective view of another embodiment of an apparatus for attaching a flower to a Christmas tree.

FIG. 7 is a partial perspective view of another embodiment of an apparatus for attaching a flower to a Christmas tree. The apparatus 54 is identical to the apparatus 48 of FIG. 6 except that an ornament 56 is attached directly to the bottom portion of the hook 50 instead of via an opening 52. In the embodiment shown in FIG. 7, the ornament 56 attached directly to the hook 50 is a pine cone.

Figure 8:
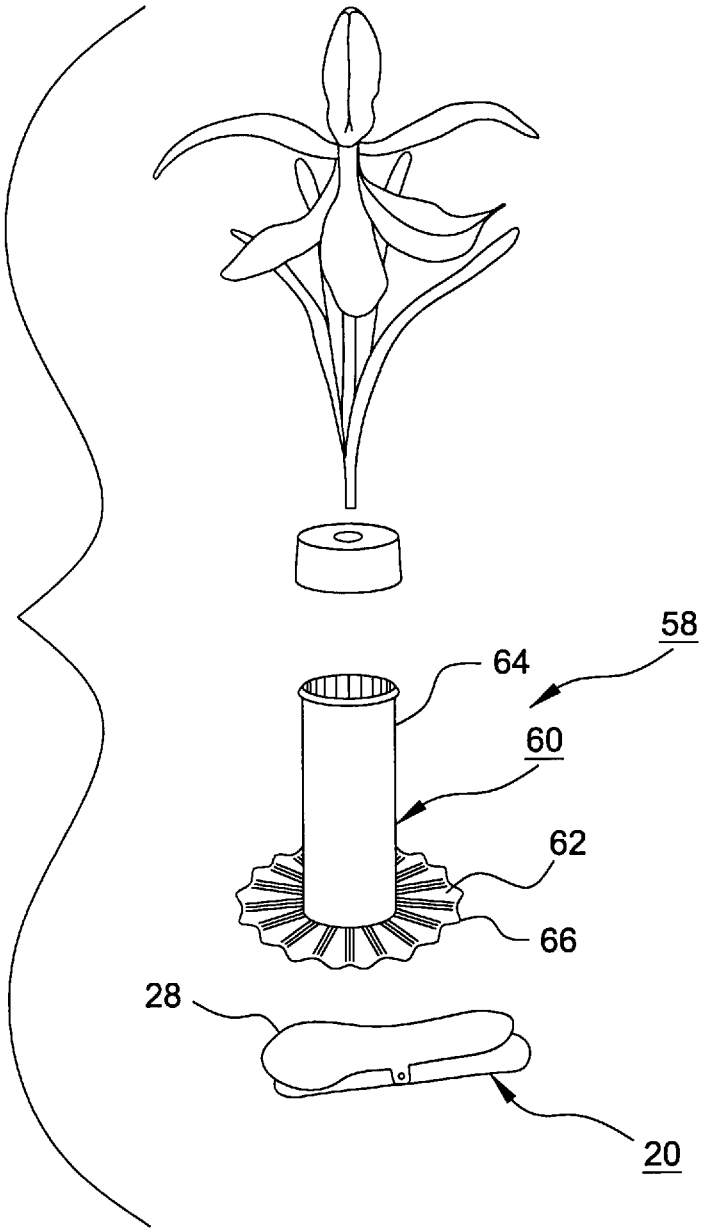
FIG. 8 is an exploded perspective view of another embodiment of an apparatus for attaching a flower to a Christmas tree.

FIG. 8 is an exploded perspective view of another embodiment of an apparatus for attaching a flower to a Christmas tree. The apparatus 58 is identical to the apparatus 6 of the preferred embodiment except that the container assembly 60 is not formed from a single piece of synthetic resin. Instead, a substantially flat disc 62 is attached to the bottom end of the container 64. A top portion of opposing member 28 of the attaching mechanism is attached to the base of the disc 62 by glue or epoxy. A perimeter 66 of the disc 62 is irregularly shaped. The disc can be manufactured from any light-weight material, such as tin.

Figure 9:
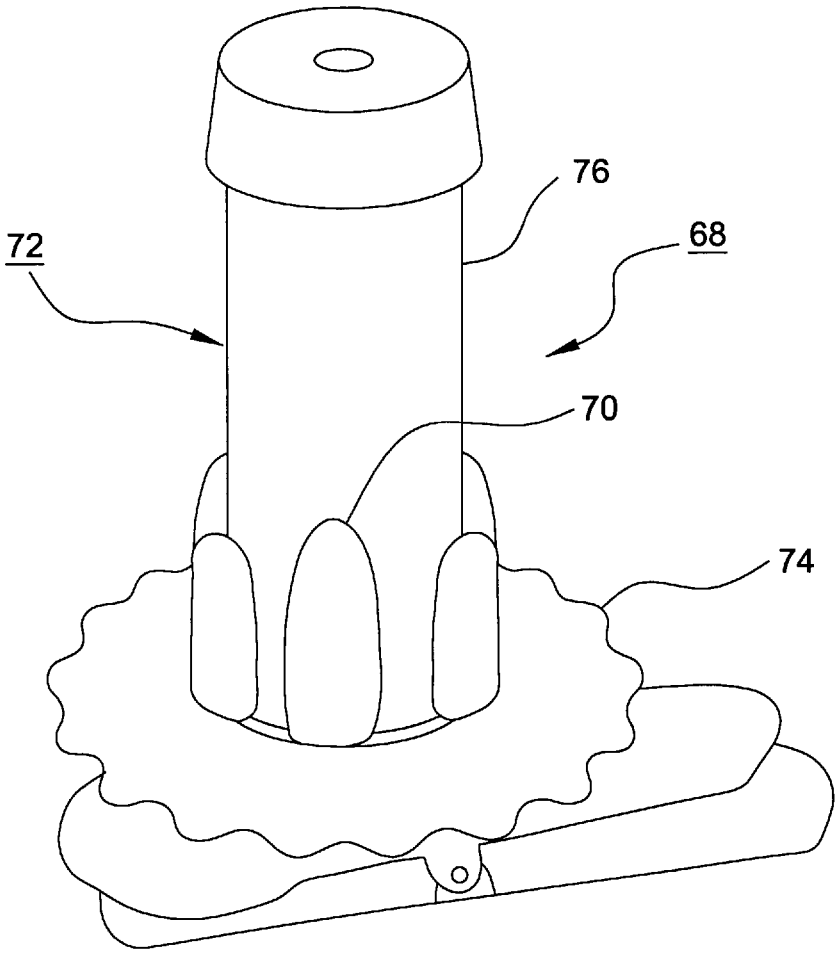
FIG. 9 is a perspective view of another embodiment of an apparatus for attaching a flower to a Christmas tree.
Figure 10:
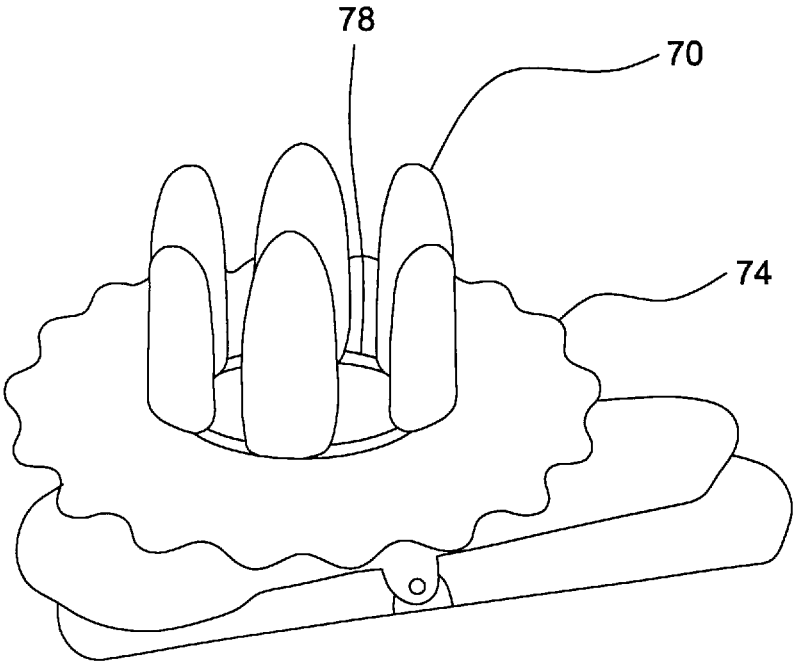
FIG. 10 is a partial perspective view of the apparatus of FIG. 9.
Figure 11:
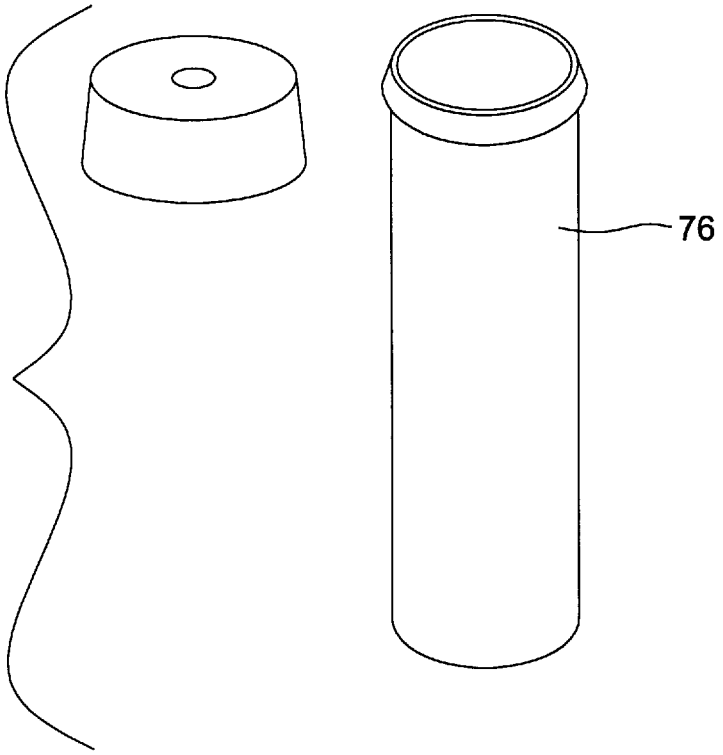
FIG. 11 is an exploded partial perspective view of the apparatus of FIG. 9.

FIG. 9 is a perspective view of another embodiment of an apparatus for attaching a flower to a Christmas tree. FIG. 10 is a partial perspective view of the apparatus of FIG. 9. FIG. 11 is an exploded partial perspective view of the apparatus of FIG. 9. The apparatus 68 is identical to the apparatus 58 of FIG. 8 except that projections 70 are included around the container assembly 72. Each projection 70 is elongated and extends from the disc 74 along the direction of elongation of the container 76. The container 76 is removable from the disc 74 as shown in FIGS. 10 and 11. The projections 70 about the container 76 and hold the container in place on the disc 74. The projections 70 thus obviate the container 76 from having to be attached to the disc 74 by glue or epoxy. A circular indentation 78 is provided oil an upper surface of the disc 74 to also hold the container 76 in place on the disc 74.

Figure 12:
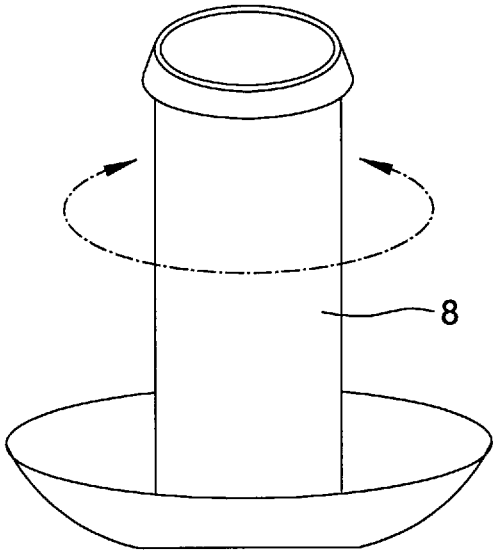
FIG. 12 is a partial perspective view of the apparatus of FIG. 2.
Figure 13:
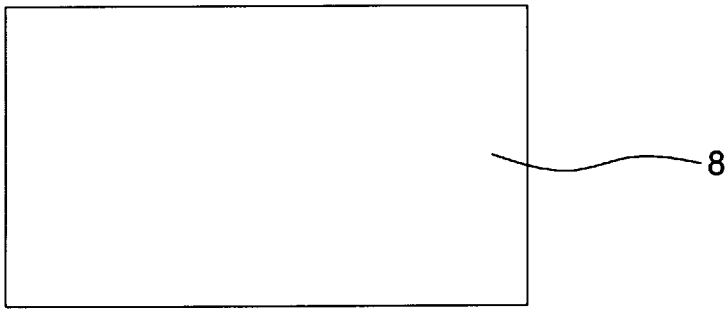
FIG. 13 is a partial elevational view of an embodiment of the container of FIG. 12.
Figure 14:
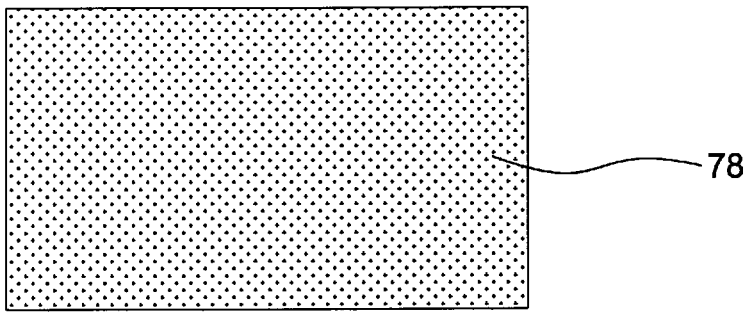
FIG. 14 is a partial elevational view of another embodiment of the container of FIG. 12.
Figure 15:
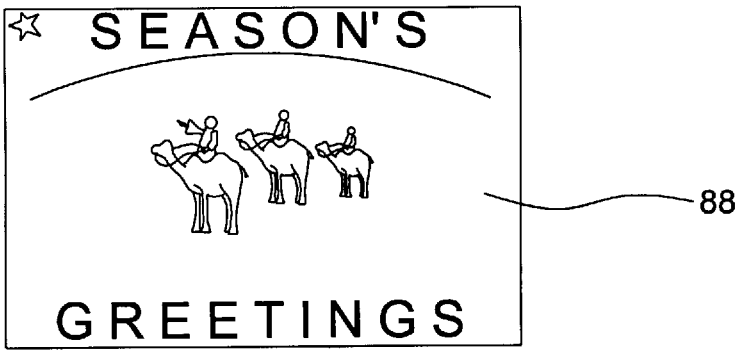
FIG. 15 is a partial elevational view of another embodiment of the container of FIG. 12.

FIG. 12 is a partial perspective view of the apparatus of FIG. 2. FIG. 13 is a partial elevational view of an embodiment of the container of FIG. 12. FIG. 14 is a partial elevational view of another embodiment of the container of FIG. 12. FIG. 15 is a partial elevational view of another embodiment of the container of FIG. 12.

In the preferred embodiment shown in FIG. 13, the container 8 is manufactured from a clear synthetic resin. Manufacturing the container 8 from clear synthetic resin enables a user to see easily how much water is in the container 8 to determine when the container 8 needs to be refilled. However, the container 78 can also be colored, as shown in FIG. 14. In the embodiment shown in FIG. 15, the container 88 is provided with a design appropriate for Christmas. The design can be provided on the container 88 in either two or three dimensions.

The apparatus in accordance with the invention provides the advantage of attaching a flower to a Christmas tree while also increasing the longevity of the flower thus attached. The flower is kept fresh because its stem remains immersed in water while attached to the Christmas tree.

Various changes may be made to the described embodiments. For example, the container can be formed into any shape that is capable of holding water and a flower with the stem immersed in the water. The apparatus can be formed of any light-weight material such as synthetic resin, tin or aluminum. The apparatus can be plain or elaborately decorated.

Although the attaching mechanism is only shown at the bottom of the container, it can be attached anywhere along the length of the container. The attaching mechanism is preferably a clamp, but it can also include a pair of wires of any other apparatus for attaching the container to the Christmas tree.

Still other modifications, which will occur to persons skilled in the art, may be made without departing from the scope of the invention as defined in the following claims.

What is claimed is:

1. An apparatus for removably attaching a flower to a branch of a Christmas tree, comprising:

a container assembly including a container and a saucer, the container defining an aperture at an upper end, the saucer disposed at a bottom of the container and extending from an axis of the container beyond a periphery of the container;

means for removably attaching the container assembly to the branch of the Christmas tree, the means for removably attaching disposed beneath the saucer.

2. The apparatus of claim 1, wherein the container is hollow and elongated.

3. The apparatus according to claim 2, wherein the container is a circular cylinder.

4. The apparatus according to claim 1, further including a top at the upper end of the container, the top defining a hole that is smaller than the aperture of the container, wherein a stem of the flower is insertable through the hole.

5. The apparatus according to claim 1, wherein the container assembly is formed from a single piece of synthetic resin.

6. The apparatus according to claim 1, wherein the means for removably attaching is connected to the container assembly by glue.

7. The apparatus according to claim 1, wherein the means for removably attaching is connected to the container assembly by a ball joint.

8. The apparatus of claim 1, wherein the means for removably attaching includes means for clamping.

9. The apparatus of claim 8, wherein the means for clamping includes two opposing members that form a jaw.

10. The apparatus according to claim 9, wherein the two opposing members are connected to each other by at least one pin.

11. The apparatus according to claim 10, wherein the two opposing members each have a distal end and a proximal end, and the members are manually operable such that moving the proximal end of the members together moves the distal end of the members apart.

12. The apparatus according to claim 1, wherein the means for removably attaching includes a hook.

13. A method of removably attaching a flower having a stem to a branch of a Christmas tree, comprising:

inserting the stem of the flower into a container assembly that includes a container and a saucer such that the stem of the flower extends into the container via an aperture at an upper end of the container, the saucer being disposed at a bottom of the container and extending from an axis of the container beyond a periphery of the container;

removably attaching the container assembly to the branch of the Christmas tree with a means for removably attaching that is disposed beneath the saucer.

14. The method according to claim 13, further including inserting water into the container.

15. The method according to claim 14, further including providing a top, that defines a hole which is smaller than the aperture of the container, over the aperture of the container.

16. The method according to claim 15, wherein the stem of the flower is inserted through the hole defined in the top such that an end portion of the stem is immersed in the water.

17. The method according to claim 16, wherein the container assembly is attached to the Christmas tree such that a direction of elongation of the container is substantially parallel to a direction of elongation of the Christmas tree.

* * * * *